United States Patent [19]

DeCloux

[11] Patent Number: 5,026,046

[45] Date of Patent: Jun. 25, 1991

[54] ADJUSTABLE AUXILIARY HYDRAULIC FLUID ACCUMULATOR CONTROL FOR HYDRAULICALLY-PHASED STAIR CLIMBING EXERCISE APPARATUS

[76] Inventor: Richard J. DeCloux, 1485 Belmont St., Manchester, N.H. 03104

[21] Appl. No.: 462,835

[22] Filed: Jan. 10, 1990

[51] Int. Cl.[5] ..... A63B 23/04; A63B 21/00

[52] U.S. Cl. ..... 272/70; 272/130

[58] Field of Search ..... 272/130, 70, 134, 96, 272/97; 128/25 R

[56] References Cited

U.S. PATENT DOCUMENTS

| | | | |
|---|---|---|---|
| 2,079,594 | 5/1937 | Clem | 128/25 R |
| 3,369,403 | 2/1968 | Carlin | 272/130 |
| 3,529,474 | 9/1970 | Olson et al. | 272/70 |
| 4,235,437 | 11/1980 | Ruis et al. | 272/134 |
| 4,452,447 | 6/1984 | Lepley et al. | 272/96 |
| 4,496,147 | 1/1985 | DeCloux et al. | 272/70 |
| 4,566,692 | 1/1986 | Brentham | 272/130 |
| 4,629,185 | 12/1986 | Amann | 272/130 |
| 4,681,316 | 7/1987 | DeCloux | 272/70 |
| 4,733,858 | 3/1988 | Lan | 272/70 |

*Primary Examiner*—Stephen R. Crow

*Attorney, Agent, or Firm*—Robert K. Tendler

[57] ABSTRACT

An auxiliary cylinder is provided as an adjustable volume accumulator in communication with the two hydraulic ram cylinders utilized to phase the steps utilized in stair climbing apparatus. Step height adjustment is facilitated by providing the auxiliary cylinder with a ram and a positioning lever, with step height adjustment being accomplished through the removal of oil from the system by backing off the ram. Moving the ram forward replaces oil lost during carry out. The subject system facilitates rapid step height adjustment, facilitates lowering of the steps for permitting under-bed storage through the dropping of the steps, and makes up fluid loss during carry out for preventing step height loss. Additionally, operating cylinder component sizing is used to minimize step height growth due to thermal expansion of the fluid in the system.

4 Claims, 3 Drawing Sheets

ADJUSTABLE AUXILIARY HYDRAULIC FLUID ACCUMULATOR CONTROL FOR HYDRAULICALLY-PHASED STAIR CLIMBING EXERCISE APPARATUS

FIELD OF THE INVENTION

This invention relates to exercise stair type aerobic exercise equipment and, more particularly, to a hydraulic system for permitting rapid step height adjustment.

BACKGROUND OF THE INVENTION

Hydraulic exercise machines such as illustrated in U.S. Pat. Nos. 4,496,147; 4,480,832; 4,465,274; 4,363,481; 4,063,726; 3,702,188; 3,606,318; 3,530,766; 3,529,474; 3,128,094; and 2,079,594 have found favor because of the reliability inherent in hydraulic energy absorption systems that have so few moving parts and where there is no steel rubbing on steel. With respect to exercise stairs, three kinds of hydraulic stair systems have evolved. First, piston cylinder systems have been provided that offer hydraulic step height adjustment through a hydraulic bypass system described in U.S. Pat. No. 4,681,316. Other features of piston cylinder systems include hydraulic control for step height adjustment and long life under heavy use. Secondly, shock absorber based systems are used that are less expensive than piston cylinder systems, but do not offer the step height adjustment, rate control and the long life features of the piston cylinder systems. Thirdly, ram cylinder systems provide the cost advantages of the shock absorber based systems, and offer the rate control of the piston cylinder system, but no step height adjustment.

By way of definition, hydraulic piston cylinder systems utilize a plug, called a piston, that moves within the cylinder when a fluid under pressure is introduced into one end of the cylinder. The universal aspect of a piston is that it seals to the inside walls of a cylinder. As a result, the piston divides the cylinder into two distinct, isolated chambers. A piston rod is normally attached to the piston and extends through one of the two closed ends of the cylinder. In normal use, the piston applies a force through the rod to an object outside the cylinder as a result of fluid introduced to either the chamber above the piston or the chamber which is on the rod side of the piston. When used in an exercise device, the normal role of a hydraulic piston cylinder is reversed so that instead of turning energy into work, it acts like a pump which is activated by the user either pulling or pushing the rod, and converts his/her work into thermal energy.

Hydraulic ram cylinders are differentiated from piston cylinders by the absence of a piston. As a result, there is but one chamber in the cylinder. A portion of the rod or ram extends into the chamber and provides a surface for the fluid to push against. When fluid is introduced into this chamber, the ram is forced out of the cylinder. Rams can only push; they cannot pull. They also suffer some other deficiencies compared to piston cylinders depending upon application. However, they have two significant advantages. By having no pistons, they eliminate any problems associated with piston seal leakage; and they are inherently less expensive to manufacture than piston cylinders.

A shock absorber is merely a dashpot having a cylinder, with a piston and fluid being is compressed when the rod is pushed into or pulled from the shock absorber. In stair climbing apparatus, there is no hydraulic linkage between shock absorbers used for each step. Thus, hydraulic phasing and control is lacking in shock absorber systems.

Economics dictate which type of system is chosen for a particular application or market. The home market uses the shock absorber and ram cylinder systems, giving up the step height adjustment and life features of piston systems in exchange for a significant reduction in cost. On the other hand, the health club and other institutional markets utilize piston systems, although at a high price, for long life and the convenience of hydraulic speed and step height control.

It will be noted that the great discrimination inherent in hydraulic speed control is important in setting the precise prescription level of exercise intensity. However, speed is only half of the intensity equation. Work is a function of force and distance. The level of exercise intensity in stair climbing is determined by stepping rate and step height. Thus, one must have step height control as well as rate control for intensity control. Step height adjustment is not presently available for ram cylinder systems.

In addition to importance in measuring and setting exercise intensity, step height is a major factor in the comfortable use of a stair exercise machine. Stair climbing step height is as precise as a runners stride. A ¼ inch adjustment can turn an uncomfortable workout into a comfortable one, especially at the higher intensity levels. In piston systems hydraulic bypass adjustment provides for easy and precise step height adjustment to accommodate the needs of various height users, and users wishing to limit knee or ankle excursion. Thus, for stair climbing apparatus, step height control has heretofore only been available in piston cylinder systems via the aforementioned bypass technology.

Additionally, step height adjustment in the paired piston cylinder stair climbing hydraulic systems is a by-product of the reclamation of fluid lost Past the piston as a result of piston seal leakage. When the bypass is opened to reclaim lost fluid, the step height can be set to any portion of the maximum stroke, and locked in that position by closing the bypass. This bypass adjustment feature cannot be applied to paired ram cylinder stair climbing hydraulic systems because the rams do not seal the cylinders into separate chambers. Consequently, the ram cylinder stair climbers brought to market do not offer step height adjustment.

Although quick step height adjustment is of prime importance for ease of exercise, step height adjustment permits compact storage for units designed for home use. One such home use machine is the rotary arm stair which is designed to be stored under a bed or in a crowded closet which is important in space limited homes and apartments. With rapid step height adjustment, the arms can be rotated down so the entire apparatus can be slipped under a bed.

By way of further background, with respect to fluid loss, all hydraulic cylinders, including shock absorbers, must lubricate their rod seal in order to maintain its life. A very small amount of fluid is carried through the seal on the rod and is left outside of the cylinder on each stroke. This fluid loss is called carry out.

Fluid loss is proportional to the number of strokes. This becomes important considering that 5 million strokes per year for machines in health clubs is common; as is ½ million strokes per year for home machines.

The conventional approach to accommodating carry out in the shock absorber and ram cylinder exercise systems has been to make the initial step so high that the loss in step height caused by carry out is not objectionable. However, high initial step height is uncomfortable. Also, the uncomfortably high step height often degrades through carry out to an unusable low step height. Thus, the effective life of the machine is severely limited.

As an additional problem, all exercise energy absorption systems transfer the user's work into heating the atmosphere. To accomplish this energy transfer, the temperature of the hydraulic system must rise above ambient, and as a consequence, the fluid in the system expands. The expansion adds to the step height and is proportional to the amount of user's energy being dissipated and the coefficient of expansion of the fluid. In the current shock absorber and ram cylinder machines, this thermal expansion can make an uncomfortably high step height even higher and more uncomfortable.

SUMMARY OF THE INVENTION

In order to solve the above problems, an auxiliary cylinder is provided as an adjustable volume accumulator in communication with the two hydraulic cylinders utilized to phase the steps utilized in stair climbing apparatus. This auxiliary cylinder facilitates rapid step height adjustment; facilitates lowering of the steps for permitting under-bed storage through the dropping of the steps; and, makes up fluid loss during carry out, thereby to prevent step height loss. Step height adjustment is facilitated by providing the auxiliary cylinder with a ram and a positioning lever, with step height adjustment being accomplished through the removal of oil from the system by backing off the ram. Completely backing off the ram causes the rotary arms to drop down for under-bed storage. Moving the ram forward replaces oil lost during carry out. Additionally, in ram cylinder systems, operating cylinder component sizing is used to minimize step height growth due to thermal expansion of the fluid in the system.

As to minimizing the impact of thermal expansion in ram cylinder stair climbing hydraulic systems, an undesirable feature of current ram cylinder stair climbing hydraulic systems is that the step height changes as the machine is used. A 2 inch growth for a 14 inch step height is not uncommon. The amount of growth is proportional to the ratio of the square of the cylinder and rod diameters, and any additional oil in the system. Since the above-mentioned third cylinder adds to the oil in the system, an undesirable step height growth problem exists. Because exercise systems typically operate at temperatures of up to 140° F., depending upon the user's energy output, the typical hydraulic fluid will expand about 3% volumetrically as the result of a 60° F. rise above ambient. Current ram cylinders used in exercise stair climbing hydraulic systems typically have rod diameters of 7/16 inch, cylinders with a ¾ inch bore, and a stroke length of 14 inches. As a result of this geometry, the stroke of the system will change about 15% or more than 2 inches.

As part of the Subject Invention, the most efficacious way to change this growth rate is to increase the ratio of rod diameter to bore diameter so that it approaches 1:1. To facilitate this improvement in rod to bore ratio, an increase in diameter of both rod and bore accommodates the rod seals and necessary clearances while yielding an improved ratio. A 2-inch diameter bore with a 1⅞ diameter rod and a third cylinder oil reserve equal to 20% of total system fluid, yields only a 4.5% growth rate.

Thus, a ram diameter to cylinder diameter ratio of approximately 1:1 results in only a 4.5% extension of the stairs for a 3% oil expansion; whereas, a 3% oil expansion in prior ram cylinder systems results in a 15% increase in extension.

While the Subject Invention thus solves the above problems for ram cylinder systems such that a ram cylinder system can be given the life and control features of the piston cylinder system while retaining the cost advantages of the ram cylinder system, the subject techniques can also be used in single acting piston cylinder systems. Piston cylinder stair climbing hydraulic cylinder systems can work in the preferred 'rods down' position with the users' weight suspended below the cylinders. Ram cylinder systems can only be used in the 'rods up' position. Since cylinders in tension are inherently longer lasting than cylinders in compression, it is reasonable to consider use of a three cylinder system that employs piston cylinders to allow 'rods down' use. Note that when a piston cylinder is used in place of a ram cylinder, sealing against loss of fluid depends upon a piston seal as well as a rod seal.

The rate of fluid lost past piston seals in current paired cylinder stair climbing hydraulic systems is several thousand times that of the rate of fluid lost past rod seals. Piston seal efficacy is impaired by stair climbing imposed requirements on maximum breakaway force, and the cylinder manufacturing process problems of holding close specifications on dimensions and surface finishes inside a bore, as opposed to the outside of a rod.

With the current piston seal leakage rates, the required volume of fluid stored in the third cylinder would be impracticably high. However, when the piston seal leakage rate is reduced to the level of rod seal leakage, by nonstandard seals and techniques such as the Parker Zero Leakage PTFE Slip Ring Seal, the third cylinder combined with paired piston cylinders presents a lower cost alternative to the two chamber and bypass technology.

It is thus a feature of this invention that by adding a selectively operated third cylinder to the conventional two cylinder hydraulic exercise energy absorption and control system, step height adjustment capability and measured life expectancy can be added to either ram or piston systems.

Two of the cylinders in this invention are operating cylinders, with the operating cylinders linking the two steps together and separating them in proportion to the amount of fluid in the system.

In the Subject Invention, a third cylinder adds the capability of adjusting the volume of oil in the two operating cylinders, thereby providing the ability to adjust the step height. By manipulation of the third cylinder, the step height can be infinitely and conveniently adjusted from zero for storage, through mid-range for physically limited or shorter users, to full height for the largest and most aggressive exerciser. Properly sized and operated, the third cylinder also has the ability to replenish the quantity of fluid that is lost through carry out, thus extending the useful life of the machine. Additionally, cylinder sizing techniques minimize the impact of thermal expansion of fluid on step height by providing negligible step height increases for expected thermal expansion.

BRIEF DESCRIPTION OF DRAWINGS

These and other features of the subject invention will be better understood taken in conjunction with the Detailed Description and the Drawings of which.

DETAILED DESCRIPTION

Figure 1A:
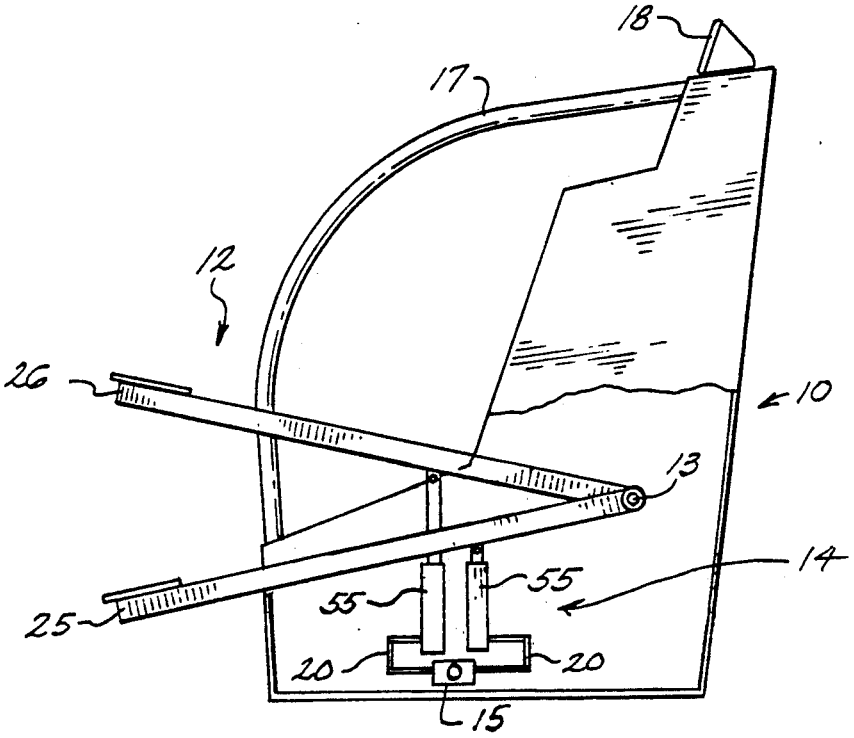
FIG. 1A is a diagrammatic illustration of two step type stair climbing apparatus, illustrating pivoted rotary arms and hydraulic phasing.

Referring now to FIG. 1A, a typical exercise machine 10 includes a pair of rotary arm steps 12 which are articulated or pivoted at points 13 so as to simulate stair climbing by virtue of the movement of the arms 25 and 26 about the pivots. The exercising individual stands at the distal end of the arms and is permitted stair climbing exercise due to the action of the arms under the control of a hydraulic phasing system 14 comprising cylinders 55 which will be described hereinafter.

The exercise machine in general is provided with hand rails 17 and a display 18 to provide the user of the equipment with an indication of the amount of exercise accomplished. The phasing of the arms of the stairs refers to the control of the position of the arms during exercise such that when one stair or exercise arm is down, the other is in an up position and vice versa. The user of the equipment therefore is provided with exercise in a body lift mode in which the user steps from the lower arm to the upper arm thereby raising his body weight.

As will be described, in the past it has been possible to phase the exercise stairs through the utilization of ram cylinders. One of the problems with ram cylinder systems is that there is no convenient way to regulate step height. Another of the problems with the ram cylinders is the fact that when the fluid in the system expands, there is a stroke increase due to temperature. "Stroke" refers to cylinder excursion. "Step height" refers to step excursion. They are proportional but not equal. Thus stroke is related to the distance between the lower stair and the upper stair which is the amount of distance that the person raises his or her body during the exercise process.

Figure 1B:
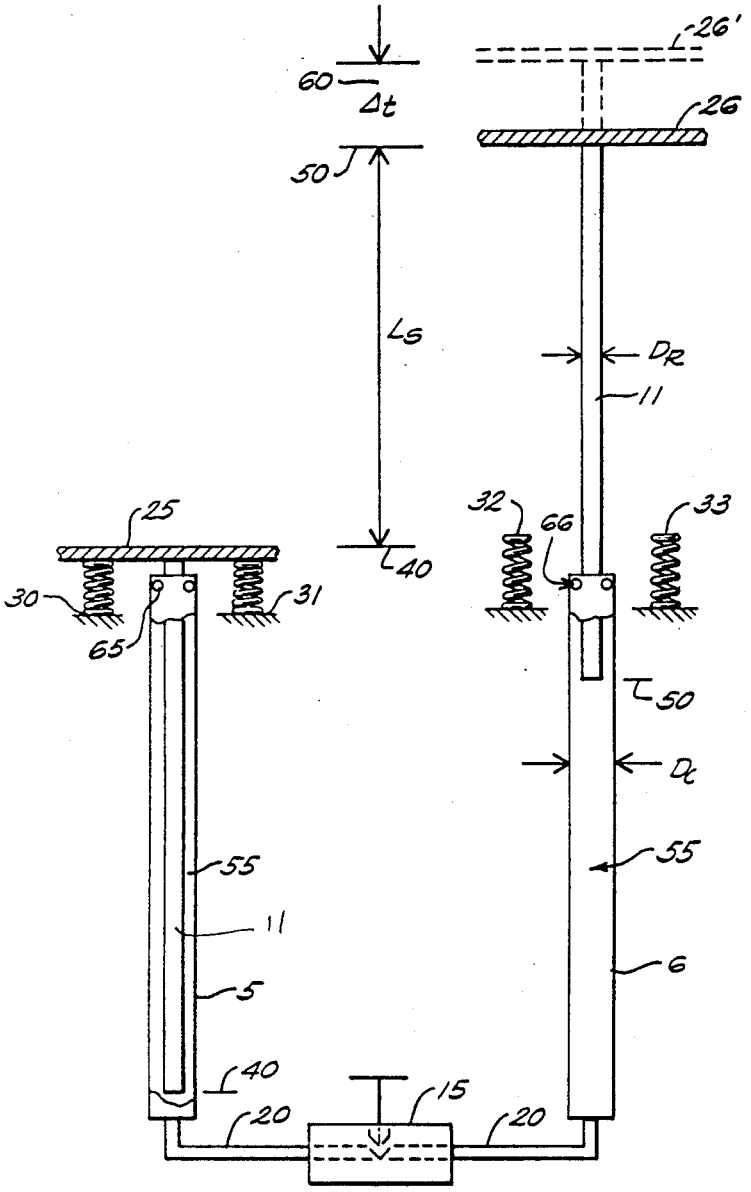
FIG. 1B is a schematic diagram of the apparatus of FIG. 1A, illustrating ram cylinder exercise stair hydraulics.

Referring now to FIG. 1B, the ram cylinder hydraulic system of FIG. 1A is shown having two hydraulic cylinders 5 and 6 which have rods 11. It is this system which suffers from a lack of ready step height adjustment, is affected by thermal expansion of the fluid in the system, and has no compensation for fluid loss due to carry out. As illustrated, a throttling valve 15 is connected between the cylinders by hose 20. Steps 25 and 26 are connected to the rods directly or through linkages (not shown). The position of the bottom most portion of the step excursion 40 and deepest penetration of the rods into the cylinders, is set by stops 30, 31, 32 and 33. The highest most position 50 of the step excursion is set by the length of the rod and the amount of fluid 55 in the system. $L_s$, or the stroke, is the difference between positions 40 and 50. It can be seen that if the amount of fluid in the system is reduced, the "up" rod 11 will descend further into its cylinder and the stroke height $L_s$ will be reduced. It can be further seen that if the fluid expands as a result of heat, the larger volume of fluid will force rod 11 further out, increasing the stroke height an amount which equals the volume of fluid expansion in cubic inches divided by the cross-section area of the rod in square inches. The determination of the amount of stroke or step height loss due to fluid carried-out past the rod seals 65 and 66 is identical to the thermal expansion calculation.

It will be readily apparent that the system described in FIG. 1B has a fixed initial step height that is established by the geometry of the cylinder and the amount of fluid put into the system. It is also readily apparent that the step height will change due to fluid expansion or fluid loss.

Practical hydraulic fluids expand about 3% when raised from ambient to typical operating temperatures. A given percentage increase of fluid volume due to temperature increase will result in a much larger percentage change in step height. Here the T stroke height increase is shown by the dotted outline 26' and stroke increase 60. For instance, in a ram cylinder system, a ½ inch diameter cylinder and 7/16 inch diameter rod will have a percentage step height increase approximately 5 times the percentage increase resulting from thermal expansion. For such a system, 15% expansion of step height is common and unwanted.

Fluid loss due to carry out is proportional to the diameter of the rod. The impact of the loss on step height is proportional to the square of the rod diameter. In the typical fourteen inch step height system with cylinders as previously described, 1 cubic inch of fluid loss, or 7% of the total, results in a decrease of step height of nine inches, or 64%, which would render the machine essentially useless.

Figure 2:
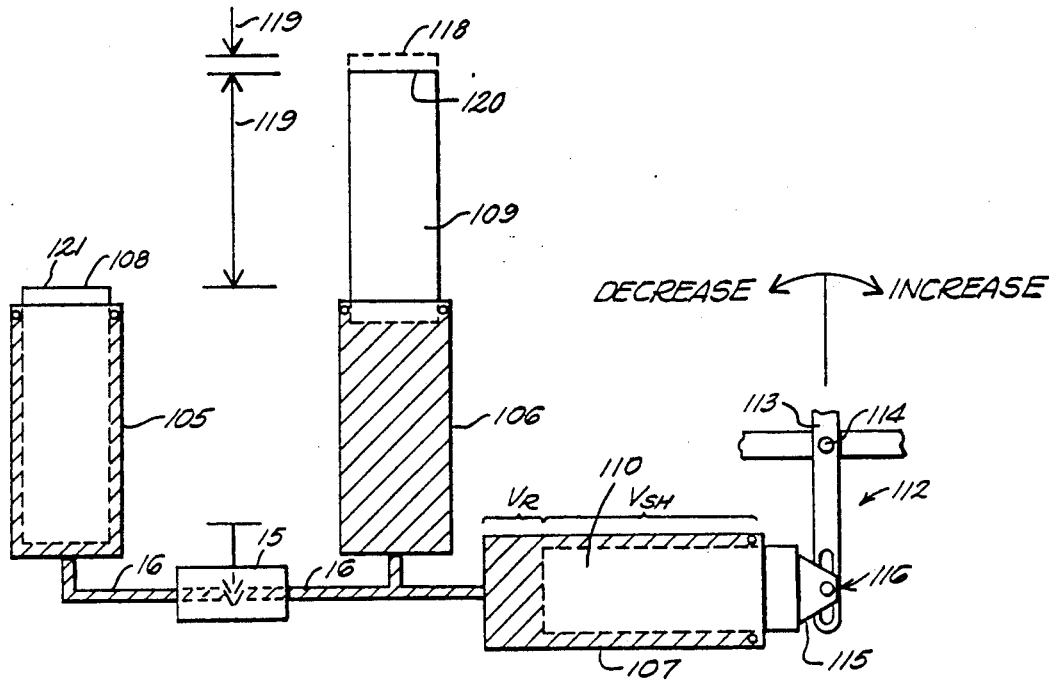
FIG. 2 is a schematic diagram of the Subject Invention, showing a third cylinder for step height adjustment and replacement of carry out oil loss, also indicating more favorable cylinder component sizing to reduce unwanted impact of thermal expansion of hydraulic fluid on step height.

FIG. 2 shows the Subject Invention having two operating ram cylinders 105 and 106, plus a third cylinder 107. Each ram cylinder has a ram, respectively shown at 108, 109, and 110. Means 112 including a lever 113 rotated about pivot 114 to a coupling 115 at the back end of ram 110, via a lost motion linkage 116 is used to control the amount of hydraulic fluid in the system. Movement of lever 113 in the directions shown by double-ended arrow 120 increases or decreases step height. Thus, movement of the lever moves ram 110 in and out to selectively add fluid to the two operating cylinders from reserve $V_r$, or to remove fluid from the operating cylinders into volume $V_s$ created by withdrawing ram 110.

The hydraulic system shown has more cubic inches of fluid than that of the conventional two cylinder system shown in FIG. 1B. As a result, the apparent response to thermal expansion is greater than that of the prior art system shown in FIG. 1B in proportion to the ratio of fluid in $V_r$ to the fluid in the operating cylinders. However, as can be seen from FIG. 2 an increase in cylinder diameter allows a more favorable rod diameter to cylinder diameter, which approaches 1:1. A 2 inch diameter cylinder, a 1 5/8 inch diameter rod, and a fluid reserve equal to 20% of the operating system, results in a step height expansion of only 1.5 times the percentage of fluid expansion. Moreover, as to carry out, with the increased diameter shown, the loss of step height for a lost cubic inch is much reduced compared to the loss of step height for the same lost cubic inch when applied to a rod of smaller diameter.

Figure 3:
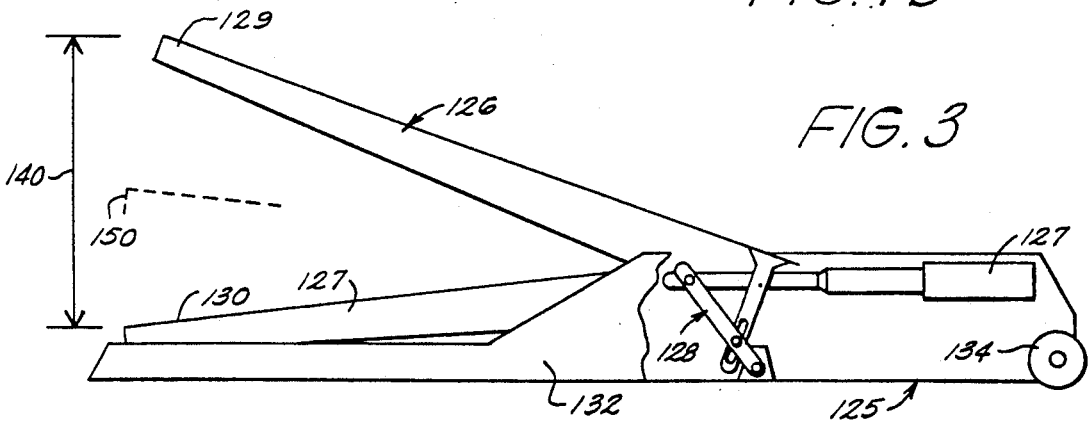
FIG. 3 is a schematic representation of the Subject Invention used in a rotating arm stair climbing machine in which the third cylinder is used to facilitate low storage profile by permitting dropping of the steps.

FIG. 3 shows a ram cylinder absorption system in a low profile rotary arm exercise machine 125 designed to store under a bed. Here the rotary arms are shown at 126 and 127, with the step phasing being controlled by respective ram cylinders, one of which is shown at 127. An appropriate linkage system 128 positions the respective arms. The arms rotate up and down, with the distal ends 129 and 130 of arms 126 and 127 providing the steps for the user. The preferred maximum step height 140 in exercise machines is 14 inches. Because depression of the rotating arm more than 6° below the horizontal raises the user's forefoot uncomfortably higher than the heel, most of the step height is generated by rotation above the horizontal. As a result, the lowest profile that can be obtained occurs when the two steps are parallel at the mid-point 150. Consequently, it is geometrically impossible to clear the typical 8 inch frame bed structure unless the step height can be mechanically adjusted, or unless enough fluid is removed to drop the steps.

In operation and referring back to FIG. 2, the initial rate at which exercise intensity is performed is controlled by a valve 15 which provides a restriction in the hydraulic line 16 between cylinders 105 and 106. In this hydraulic ram embodiment, the step height adjustment, here illustrated by dotted outline 118 and double ended arrows 119, is accomplished by moving ram 110 to the left, at which time additional fluid is added to the system which raises top portion 120 of ram 109 with respect to top portion 121 of ram 105. Thus a difference in step height can be added merely by moving a lever 113 to add fluid to the system. Likewise the step height can be reduced by withdrawing ram 110. It will also be appreciated that the movement of ram 110 in the auxiliary cylinder may be used to add fluid to the system such that carry out is no longer a problem due to the utilization of the auxiliary cylinder.

When this system is utilized in the rotary arm exercise apparatus of FIG. 3, withdrawing ram 110 in the auxiliary cylinder of FIG. 2 results in an almost complete removal of the fluid in the operating cylinders. This results in the ability to drop both of the rotary arms 126 and 127 into the base 132 of the rotary arm device such that the device can be wheeled by wheels 134 underneath a bed. It will also be appreciated that the ability to remove fluid from the system so as to collapse the exercise device down onto the base permits storage in tight areas such as small closets.

Figure 4:
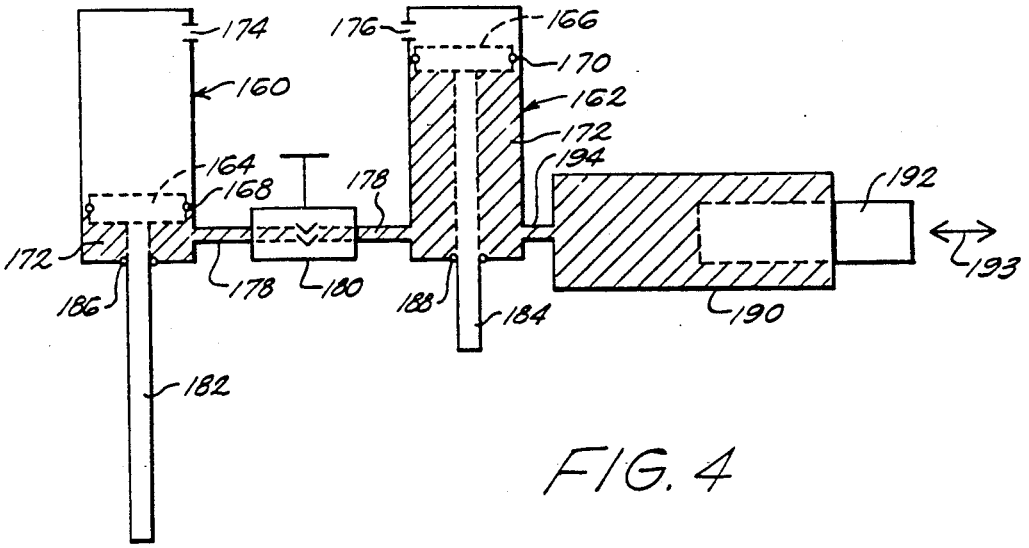
FIG. 4 is a schematic diagram of the Subject Invention used with a rods-down piston cylinder system.

Referring now to FIG. 4, while the subject invention has been described in connection with ram cylinder type systems, in this embodiment, piston cylinders are utilized in which single acting piston cylinders 160 and 162 are utilized. Within each of the cylinders is a piston 164 and 166 which is sealed to the cylinder walls via appropriate seals 168 and 170. This provides that the hydraulic working fluid 172 is always beneath the respective piston. It will also be appreciated that the cylinders are provided with ports 174 and 176 respectively so as to be able to vent the top portions of the pistons to atmosphere. Note that the single acting pistons are provided with a fluid linkage connection as illustrated at 178, with a control valve 180 disposed therein.

As can be seen this system can be used in the rods down configuration, with rods 182 and 184 depending from respective pistons 164 and 166 through rod seals 186 and 188.

An auxiliary cylinder 190 is provided with a ram 192 for the purpose of step height adjustment and to replenish fluid lost to carry out. This cylinder is coupled to the operating cylinders via a fluid conduit 194 such that cylinder 190 is in communication with both cylinders 160 and 162.

What will be appreciated from the single acting cylinder embodiment is that a rods down reliable exercise machine can be built with the advantages of step height adjustment provided by the auxiliary cylinder. Piston seals 168 and 170 are available from Parker Hannifin Corp. of Cleveland, Ohio as PTFE slip ring seals, model number 1.5BB2HKU4A4.

What will be seen in FIG. 4 is that rather than utilizing the bypass system provided for phasing the stairs in piston cylinder systems in which hydraulic fluid exists above and below each piston, the step height adjustment can be accomplished with the single acting piston system of FIG. 4 through the utilization of the subject auxiliary cylinder.

Having above indicated a preferred embodiment of the present invention, it will occur to those skilled in the art that modifications and alternatives can be practiced within the spirit of the invention. It is accordingly intended to define the scope of the invention only as indicated in the following claims:

I claim:

1. A hydraulic energy absorption system for exercise stairs comprising steps, two operating cylinders having rods engaging respective steps for phasing said steps, a hydraulic circuit connected between said two cylinders at one side only of said rods, the other side of said rods being open to the atmosphere for providing opposed motion of said rods, said circuit including a throttling valve, and means for adding fluid to or subtracting fluid from said circuit, said fluid adding or subtracting means including an auxiliary cylinder in communication with said circuit via a single conduit means, and user adjustable means for selectively forcing fluid from said auxiliary cylinder to said circuit.

2. The system of claim 1 and further including means for removing fluid from said operating cylinders to said auxiliary cylinder.

3. The system of claim 1 wherein said operating cylinders include ram cylinders.

4. The system of claim 1 wherein said operating cylinders include piston cylinders.

* * * * *